United States Patent [19]

Hennemann

[11] 4,061,993

[45] Dec. 6, 1977

[54] TRIPPING DEVICE FOR PRE-SELECTION OF FUNCTION FOR ELECTRICAL EQUIPMENT

[75] Inventor: Jean Hennemann, Hombliéres, France

[73] Assignee: Unelec S.A., Paris Cedex, France

[21] Appl. No.: 662,932

[22] Filed: Mar. 1, 1976

[30] Foreign Application Priority Data

Mar. 6, 1975 France ..... 75.06966

[51] Int. Cl.[2] ..... H01H 83/20

[52] U.S. Cl. ..... 335/20; 335/174

[58] Field of Search ..... 335/20, 175, 174

[56] References Cited

U.S. PATENT DOCUMENTS

| | | | |
|---|---|---|---|
| 3,175,064 | 3/1965 | Myers | 335/20 |
| 3,215,801 | 11/1965 | Nimylowycz | 335/20 |
| 3,293,577 | 12/1960 | Kiesel et al. | 335/20 |

*Primary Examiner*—Harold Broome

*Attorney, Agent, or Firm*—Haseltine, Lake & Waters

[57] ABSTRACT

Tripping devices, more particularly for circuit-breakers, in which a single model tripping device can be transformed by a simple operation, not requiring any dismantling, to obtain either a shunt or undervoltage type of operation. This result can be obtained by changing the relative position of a catch part of the striker, for example by rotation through 180 degrees in relation to a locking part.

10 Claims, 3 Drawing Figures

TRIPPING DEVICE FOR PRE-SELECTION OF FUNCTION FOR ELECTRICAL EQUIPMENT

FIELD OF THE INVENTION

The present invention relation tripping devices and, more particularly, voltage emission or shunt trips and undervoltage trips for electrical equipment and more especially for circuit-breakers.

BACKGROUND

It is known that a voltage emission or shunt trip is currently used for causing the opening of a circuit-breaker by means of a control device situated at a distance.

Likewise, an undervoltage trip is currently used for causing the opening of a circuit-breaker as a safety means when the voltage of the mains falls below a certain level. Such tripping devices comprise, generally, a striker operating a tripping element of the circuit-breaker and operative as a function of an electromagnet which exerts magnetic attraction by energizing of the control winding, in the case of a voltage emission tripping device or a tripping device which effects release by de-energizing of the control winding in the case of an undervoltage trip. These tripping devices are therefore different according to whether the tripping device is of the type which exerts magnetic attraction or of the type which effects release.

It is therefore compulsory, more particularly in a maintenance service, to have tripping devices of both types.

SUMMARY OF THE INVENTION

The present invention seeks, on the contrary, to provide a tripping device having a single transformable embodiment, with simple operation not requiring any dismantling, either as a voltage emission or shunt trip or as an undervoltage trip.

The tripping device according to the invention has the advantage of preselecting the required operation from among at least two others and is essentially characterized in that it comprises a striker provided with a projecting part forming a catch for a locking part connected to a mobile part of the control means and in that the modification of the relative position of the said projecting part with respect to the said locking part enables the changeover from one operation to another.

According to a preferred embodiment of the invention, the striker is able to move in a linear direction along an axis about which a part forming the catch means can be set in two stable positions which are diametrically opposite; in one of the positions, the catch part engages with a part of the locking part and is released by a movement in one direction of the locking part; in the other position, the part forming the catch part enagages with another part of the locking part and is released by a movement in the other direction of the locking part; the movement of the locking part is connected either directly or through connection parts (connecting rod or lever) with the movement, in one direction or the other, of the mobile part of the trip control electromagnet.

BRIEF DESCRIPTION OF THE DRAWING

The object and the other characteristics of the present invention will become more apparent from the description of an embodiment having no limiting character and in connection with the drawing, in which.

DETAILED DESCRIPTION

Figure 1:
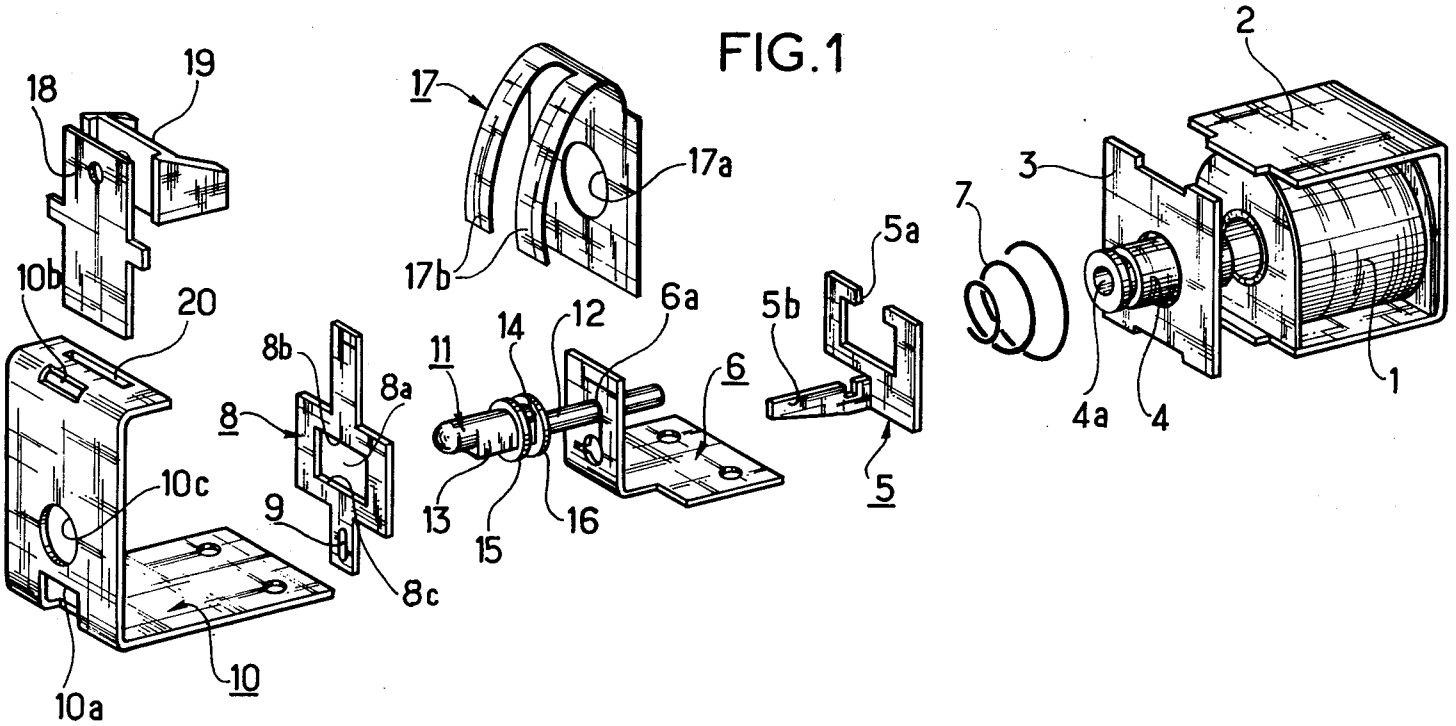
FIG. 1 shows a tripping device in a perspective exploded view.

In FIG. 1, the tripping device comprises, from right to left, a control electromagnet, a return spring 7, a control lever 5, a support part 6, a striker 11, a locking part 8, a percussion spring 17 and a cocking lever 18 connected with a guide part 10.

The electromagnet is constituted by an energizing winding 1, a fixed, U-shaped magnetic armature 2, a magnetic closing plate 3 and a plunger core 4 sliding in the winding through a hole formed in the closing plate 3.

The control lever 5 is articulated on the fixed support part 6 and engaged at one of its ends 5*a*, which is forked, in a groove of the plunger core 4 with slight play.

The return spring 7 surrounds the plunger core 4 and is compressed between the closing plate 3 and the forked end 5*a* of the control lever 5.

The locking part 8 has which receives a slot 9 in the other end 5*b* of the control lever 5 and is installed in a sliding configuration in recesses 10*a* and 10*b* formed in the fixed guide part 10.

The striker 11 provided with an axle 12 is guided, on one side, in a hole 6*a* in the fixed support part 6 and, on the other side, by a hole 4*a* formed in the axle of the plunger core 4. The striker 11 comprises a projecting part 13, forming a catch with the locking part 8 and a flat part 14, comprised between two projecting parts in the form of disks 15 and 16.

The U-shaped leaf-type percussion spring 17 has an opening 17*a* allowing the core 4 to pass therethrough, and the spring 17 is held, on one side, against the closing plate 3, whereas the other side is subdivided into two branches 17*b* engaged with a slight gripping on either side of the flat part 14 between the two disk-shaped parts 15 and 16 of the striker 11. It is thus possible, by means of the flat part 14, to impart to the striker 11 two stable positions which are diametrically opposite about its axle 12 without its being possible for the branches 17*b* of the spring 17 to escape from the space formed between the disks 15 and 16.

To ensure the selecting of the operation, the striker 11 passes through an aperture 8*a* in the locking part 8 whose edges 8*b* and 8*c* can engage with the projecting part 13 forming a catch of the striker 11 according to the position of the said striker about its axle 12.

The cocking lever 18 provided with a heel 19 is installed in a pivoting configuration in a slot 20 in the fixed guide part 10 whose hole 10*c* allows the striker 11 to pass through.

Figure 2:
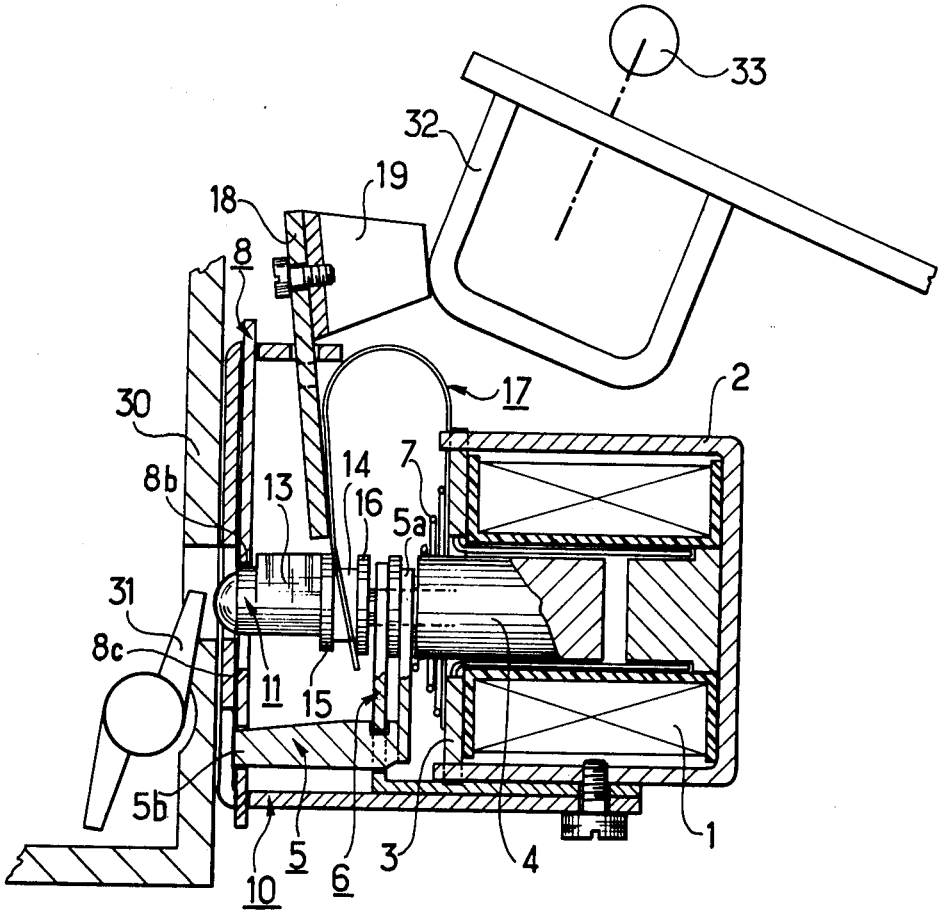
FIGS. 2 and 3 show a cross-section of the tripping device in FIG. 1 with a striker arranged to ensure the voltage emission operation and in the respective "cocked" and tripped positions.

In FIG. 2, the tripping device is in the "cocked" position and the winding 1 is not energized. The tripping device is fixed onto a part 30 of the housing of the circuit-breaker with which it co-operates, the striker 11 being arranged in facing relation with a tripping device 31 of the circuit-breaker. The part 32 is a part which is mobile about the axle 33 of the circuit-breaker shown in the open position and by its action on the heel 19 of the cocking lever 18, it has caused the cocking of the tripping device during the opening of the circuit-breaker and is shown in its end-of-opening position.

Figure 3:
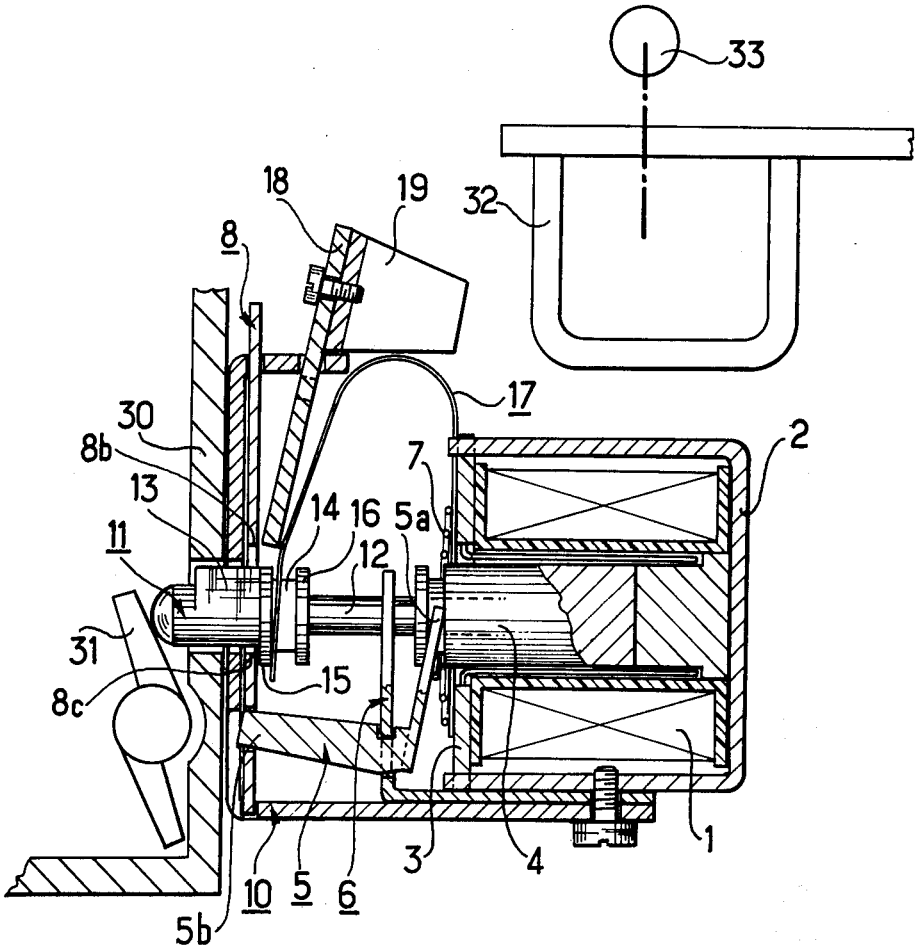

When the circuit-breaker is closed, the part 32 comes to the position where it is shown in FIG. 3 and consequently releases the lever 18, whereas the projecting part 13 of the striker 11 remains enagaged with the part 8*b* of the locking part 8, as shown in FIG. 2.

When the winding 1 is energized, more particularly by remote-control, the plunger core 4 is attracted towards the inside of the winding, against the pull of the return spring 7; it draws away the forked end 5*a* of the lever 5 whose other end 5*b* moves the locking part 8 upwards. The projecting part 13 forming a catch with the part 8*b* of the locking part 8 is thus released and the striker 11, urged by the percussion spring 17 pushing on the disk 15, strikes the tripping element 31 of the circuit-breaker. The tripping device is then in the position shown in FIG. 3, whereas the consecutive tripping of the circuit-breaker then makes the part 32 strike the heel 19 of the cocking lever 18 and the latter, by its other end, recompresses the percussion spring 17, thus drawing the striker 11 into the cocked position by its effect on the disk 16. Simultaneously, the energizing of the winding 1 having ceased, the return spring 7 brings the plunger core 4, the control lever 5 and the locking part 8 back into the original position in FIG. 2 as soon as the projecting part 13 has passed again to the other side of the locking part 8.

To arrange the striker 11 in the position ensuring the undervoltage operation of the tripping device, it is necessary only to make the striker 11 turn through 180° about its axle 12. In this type of operation, the winding 1 is normally energized by the voltage of the mains. In the "cocked" position, the plunger core 4, the spring 7, the lever 5 and the locking part 8 would be in the positions shown in FIG. 3. The other parts would be in the positions shown in FIG. 2, except for the striker 11, which would assume a symmetrical position in relation to its axle 12, that is, with the projecting part 13 situated towards the bottom, hence engaged with the part 8*c* of the locking part 8. In the same way as previously, when the circuit-breaker is closed, the part 32 comes to the position shown in FIG. 3 and consequently releases the lever 18, whereas the projecting part 13 of the striker 11 remains engaged with the part 8*c* of the locking part 8. On the de-energizing of the winding 1, for example, by a great drop in the mains voltage the electromagnetic forces exerted on the plunger core become insufficient with respect to the return pull of the spring 7 which consequently draws the control lever 5 and the plunger core 4 towards the left and the locking part 8 downwards, thus releasing the striker 11, whose projecting part 13 is released from the locking part 8. By striking the tripping device 31, the striker 11 causes the opening of the circuit-breaker and the part 32 in its turn strikes the heel 19 of the "cocking" lever 18, thus bringing the percussion spring 17 and the striker 11 into the original position, whereas the plunger core 4, the control lever 5, and the locking part 8 resume their original positions only if the mains voltage has been re-established at a sufficient level for the electromagnetic forces to attract the plunger core 4 inside the winding against the pull of the return spring 7.

It is self-evident that this embodiment of the invention has no limiting character and that the field of its protection applied for by the present application, comprises all variants corresponding to the general definition which has been given thereof.

Thus, the connection between the locking part and the mobile control part can be made just as well by a connecting rod as by a lever. A direct connection, more particularly by transformation of the linear movement of the mobile control part, in a perpendicular movement of the locking part, by suitably inclined inter-contacting surfaces can also be provided.

Or, even, in another embodiment, the mobile control part can be arranged so as to move perpendicularly to the direction of movement of the striker and thus drive the locking part made integral with the said mobile control-part, directly.

I claim:

1. A tripping device having two selectable configurations comprising electromechanical control means having energized and deenergized states and including a mobile member having retracted and extended positions related to the state of the electromechanical control means, striker means operatively coupled to said mobile member for operating a circuit breaker depending upon the state of said electromechanical control means, displaceable locking means having a lock position for holding the striker means in a locked position, and coupling means between the mobile member and said locking means for displacing the locking means, upon change of energization state of the electromechanical control means, from said lock position to a release position in which the striker means can trip the circuit breaker, said electromechanical control means in one configuration of the tipping device going from energized to deenergized state and in a second configuration going from deenergized to energized state, said striker means including a projecting part forming a catch which engages with said locking means such that the striker means is held in locked position, said projecting part being movable between first and second positions, corresponding to the first and second configurations, in which said projecting part respectively engages said locking means with the latter in lock position and is released therefrom when the locking means moves to release position such that solely by moving the projecting part between said first and second positions the tripping device is placed into the selected configuration.

2. A tripping device as claimed in claim 1 wherein said locking means undergoes displacement in respective opposite directions when the electromechanical control means respectively goes from energized to deenergized state and from deenergized to energized state, said projecting part being shaped to occupy offset positions relative to the locking means to engage said locking means and to block movement of the striker means in the initial state of the electromechanical control means for both configurations.

3. A tripping device as claimed in claim 2 wherein one of the configurations of the tripping device is a shunt tripping configuration and the other is an undervoltage tripping configuration, said locking means including respective positions engageable with said projecting part in the two configurations.

4. A tripping device as claimed in claim 3 wherein said striker means is displaceable linearly along an axis and said projecting part is placed in diametrically opposed position relative to said axis in said first and second positions thereof.

5. A tripping device as claimed in claim 4 wherein said locking means is movable substantially perpendicular to said axis.

6. A tripping device as claimed in claim 5 wherein said coupling means comprises a lever coupled to said mobile member and to said locking means.

7. A tripping device as claimed in claim 6 wherein said lever is pivotably supported and includes one end engaged with play with said mobile member and an opposite end engaged with said locking means.

8. A tripping device as claimed in claim 4 wherein said striker means includes two spaced disk-shaped parts, a flat part between said disk-shaped parts, a leaf-type spring having one end with a slot therein forming spaced strips engaged with said flat part and urging said striker means in a direction for operation of the circuit breaker.

9. A tripping device as claimed in claim 2 wherein said locking means comprises a plate having an aperture through which said striker means can pass when going from locked position to the position for tripping the circuit breaker, said projecting part respectively engaging said plate above and below said aperture for the two configurations.

10. A tripping device as claimed in claim 9 wherein said striker means moves linearly and said plate moves in a plane perpendicular thereto, said projecting part engaging the plate above the aperture when said plate moves upwards to release position of the locking means in a first configuration and engaging the plate below the aperture when said plate moves downwards to release position of the locking means in the second configuration.

* * * * *